US012492867B2

(12) United States Patent
Palaty et al.

(10) Patent No.: US 12,492,867 B2
(45) Date of Patent: Dec. 9, 2025

(54) AIR SHROUDS WITH INTEGRATED HEAT EXCHANGER

(71) Applicant: Applied Materials, Inc., Santa Clara, CA (US)

(72) Inventors: Abraham Palaty, Thrissur (IN); Vinodh Ramachandran, Bangalore (IN); Shu-Kwan Lau, Sunnyvale, CA (US); Shainish Nellikka, Bangalore (IN); Raja Murali Dhamodharan, Madurai (IN); Danny D. Wang, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 703 days.

(21) Appl. No.: 17/730,038

(22) Filed: Apr. 26, 2022

(65) Prior Publication Data

US 2023/0341186 A1 Oct. 26, 2023

(51) Int. Cl.

| | |
|---|---|
| ***F28D 1/02*** | (2006.01) |
| ***F28D 1/047*** | (2006.01) |
| ***F28F 1/24*** | (2006.01) |

(52) U.S. Cl.

CPC ..... *F28D 1/0226* (2013.01); *F28D 1/024* (2013.01); *F28D 1/0477* (2013.01); *F28F 1/24* (2013.01); *F28D 2001/0286* (2013.01)

(58) Field of Classification Search

CPC ..... F28D 1/0226; F28D 1/24; F28D 1/0477; F28D 2001/0286; F28D 2001/0273

See application file for complete search history.

(56) References Cited

U.S. PATENT DOCUMENTS

| | | | | |
|---|---|---|---|---|
| 2,162,152 | A * | 6/1939 | Wulle | F24F 3/14 55/482 |
| 2,610,484 | A * | 9/1952 | Lange | F25D 17/067 165/125 |
| 3,759,321 | A * | 9/1973 | Ares | F25B 39/04 165/125 |
| 5,446,825 | A * | 8/1995 | Moslehi | C23C 16/481 118/724 |
| 6,367,410 | B1 * | 4/2002 | Leahey | H01L 21/67103 118/724 |
| 6,970,644 | B2 | 11/2005 | Koren et al. | |
| 9,267,390 | B2 * | 2/2016 | Lo | F02C 6/08 |
| 9,748,121 | B2 * | 8/2017 | Ranish | C23C 16/463 |
| 2006/0160365 | A1 | 7/2006 | Wang | |

(Continued)

FOREIGN PATENT DOCUMENTS

| | | | |
|---|---|---|---|
| KR | 100843958 | B1 | 7/2008 |
| WO | 2014176174 | A1 | 10/2014 |

OTHER PUBLICATIONS

International Search Report and Written Opinion dated May 9, 2023 for Application No. PCT/US2023/010022.

*Primary Examiner* — Devon Lane

(74) *Attorney, Agent, or Firm* — Patterson + Sheridan, LLP

(57) ABSTRACT

A heating module for a substrate processing chamber includes heating lamps coupled to a reflector plate and a heat exchanger. The heat exchanger cools a gas within the heating module. A fan within the heating module circulates the gas through apertures in the reflector plate to cool the heating bulbs. The gas is cooled by the heat exchanger, and is recirculated. One or more shrouds directs the gas as the gas is being circulated.

14 Claims, 10 Drawing Sheets

(56) References Cited

U.S. PATENT DOCUMENTS

| | | | | |
|---|---|---|---|---|
| 2007/0023174 | A1* | 2/2007 | Brost | F28F 9/001 165/DIG. 373 |
| 2012/0227944 | A1* | 9/2012 | Moisidis | A61B 6/4488 165/172 |
| 2014/0295106 | A1* | 10/2014 | Sivaramakrishnan | C23C 16/0209 118/724 |
| 2016/0111305 | A1 | 4/2016 | Kumar et al. | |
| 2016/0227606 | A1 | 8/2016 | Samir et al. | |
| 2017/0103907 | A1 | 4/2017 | Chu et al. | |
| 2019/0219337 | A1* | 7/2019 | Twelves | F28D 7/1623 |
| 2021/0189593 | A1* | 6/2021 | Burrows | C23C 16/4411 |
| 2022/0282925 | A1* | 9/2022 | Daggett | F28D 1/047 |
| 2023/0341186 | A1* | 10/2023 | Palaty | F28D 1/0226 |
| 2024/0302114 | A1* | 9/2024 | Onaka | F28F 1/128 |

* cited by examiner

AIR SHROUDS WITH INTEGRATED HEAT EXCHANGER

BACKGROUND

Field

Embodiments of the present disclosure generally relate to a heat exchanger for use with a substrate processing chamber, such as an epitaxial deposition chamber.

Description of the Related Art

Semiconductor substrates are processed for a wide variety of applications, including the fabrication of integrated devices and microdevices. During processing, the substrate is positioned on a support within a processing chamber. The interior of the processing chamber is placed under vacuum while the substrate is processed by exposure to heat and process gases. Some processing chambers, such as some epitaxial deposition chambers, use lamps to heat the substrate. Temperature control can be facilitated by cooling the lamps and portions of the processing chamber. In some examples, the lamps and portions of the processing chamber are cooled by a flow of air provided by ducting. The ducting takes up space, and the produced air currents can result in an uneven temperature distribution across the processing chamber, which can adversely impact the quality of the process being performed on the substrate.

There is a need for improved systems and processes that facilitate cooling heating lamps and portions of the processing chamber.

SUMMARY

The present disclosure generally relates to a heat exchanger for use with a substrate processing chamber, such as an epitaxial deposition chamber.

In one embodiment, a heating module for a process chamber includes an outer housing, a lid on the outer housing, a reflector plate disposed in the outer housing, and a plurality of heating lamps associated with the reflector plate. A first heat exchange module is disposed between the reflector plate and the lid, the first heat exchange module including a plurality of first heat exchange tubes disposed between a first inner shroud and a first outer shroud.

In another embodiment, a processing chamber includes a chamber body including a upper window disposed above a lower window, the upper window and the lower window forming boundaries of a processing volume. The processing chamber further includes an upper heating module coupled to the chamber body above the upper window. The upper heating module includes a first outer housing, a first lid on the first outer housing, a first reflector plate disposed in the first outer housing, and a plurality of first heating lamps associated with the first reflector plate. The upper heating module further includes a first heat exchange module disposed between the first reflector plate and the first lid, the first heat exchange module including a plurality of first heat exchange tubes disposed between a first inner shroud and a first outer shroud.

In another embodiment, a heat exchange module includes an enclosure. The enclosure includes an inner shroud extending between first and second end plates, and an outer shroud extending between the first and second end plates. The heat exchange module further includes a plurality of heat exchange tubes disposed within the enclosure, and a plurality of inner plates disposed within the enclosure and coupled to each heat exchange tube. The inner shroud, the outer shroud, and each heat exchange tube are curved in a horizontal plane.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of scope, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure concerns a heat exchanger for use with a substrate processing chamber, such as an epitaxial deposition chamber. The heat exchanger is contained within one or more heating modules that are configured to heat a processing volume with the processing chamber. The heat exchanger cools a cooling gas, such as air, within the one or more heating modules. One or more fans are operated to direct the cooling gas towards heating lamps within the one or more heating modules and towards an upper window and/or a lower window that bounds the processing volume. The cooling gas cools the heating lamps, the upper window, and/or the lower window.

Figure 1:
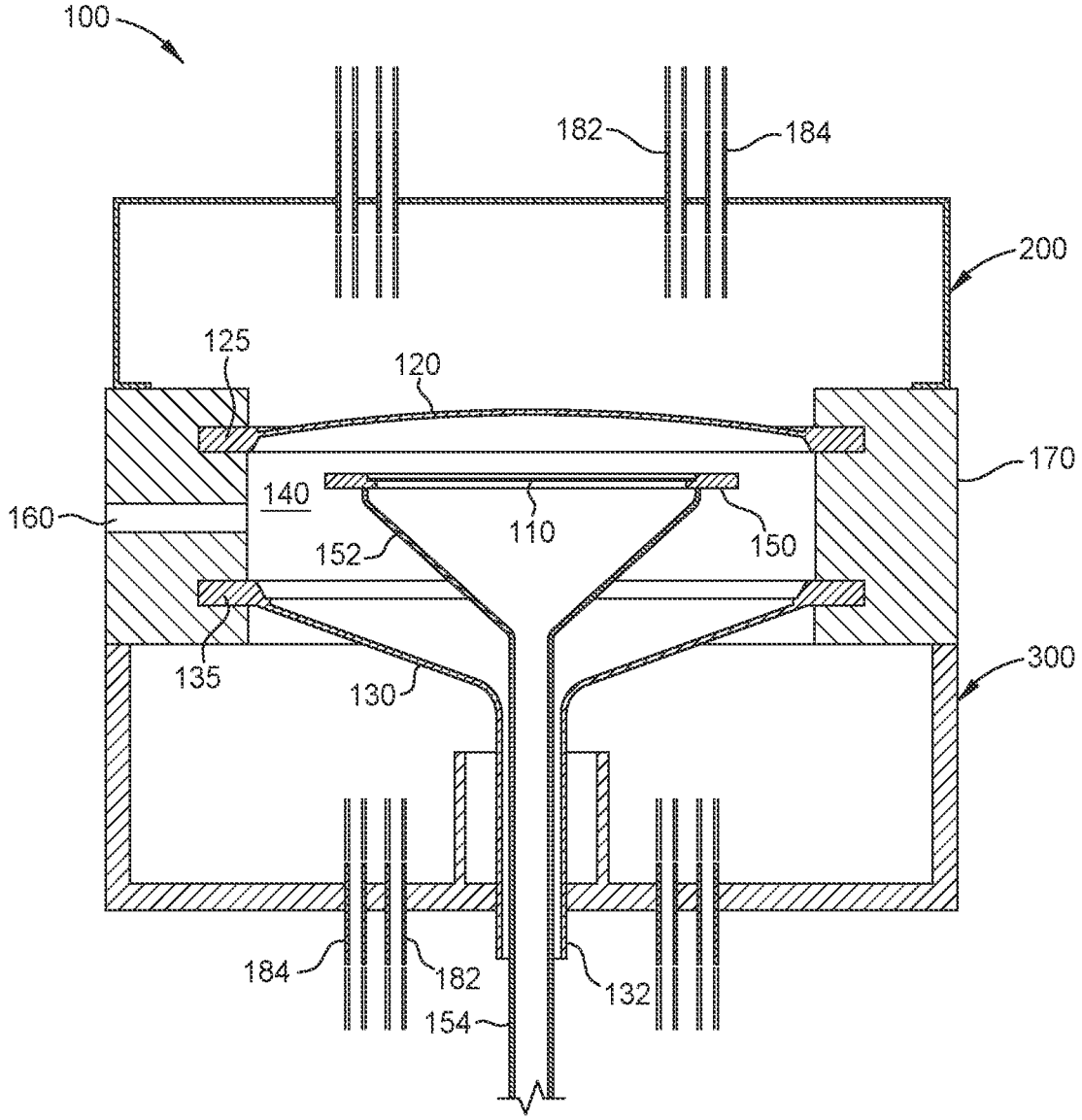
FIG. 1 is a schematic depiction of a processing chamber.

FIG. 1 shows schematically a processing chamber 100. Processing chamber 100 includes an upper heating module 200 above a chamber body 170, and a lower heating module 300 below the chamber body 170. Upper heating module 200 is shown in greater detail in FIGS. 2A-2C. Lower heating module 300 is shown in greater detail in FIGS. 3A-3C.

Processing chamber 100 may be a processing chamber for performing any thermal process, such as an epitaxial process. It is contemplated that while a processing chamber for epitaxial process is shown and described, the concept of the present disclosure is also applicable to other processing chambers capable of providing a controlled thermal cycle that heats the substrate for processes such as, for example, thermal annealing, thermal cleaning, thermal chemical vapor deposition, thermal oxidation and thermal nitridation. It is contemplated that the processing chamber 100 may be used to process a substrate, including the deposition of a material on a surface of the substrate.

Referring to FIG. 1, the chamber body 170 includes an upper window 120 and a lower window 130 with a processing volume 140 therebetween. The processing volume 140 is substantially cylindrical. The upper window 120 includes a base 125 secured in the chamber body 300, and the lower window 130 includes a base 135 secured in the chamber body 300. A neck 132 coupled to the lower window 130 is disposed about a shaft 154 of a susceptor support 152. The susceptor support 152 carries a susceptor 150, upon which a substrate 110 can be positioned within the processing volume 140.

It is contemplated that the susceptor 150 may be made of SiC coated graphite. A motor (not shown) rotates the shaft 154 of the susceptor support 152 about the longitudinal axis of the shaft 154, and thus rotates the susceptor 150, and the substrate 110. The substrate 110 is brought into the chamber body 300 through a loading port 160 and positioned on the susceptor 150.

One or more coolant inlets 182 and coolant outlets 184 are associated with the upper heating module 200 and lower heating module 300. The upper heating module 200 and lower heating module 300 heat the processing volume 140, such as by providing infrared radiant heat though the upper window 120 and the lower window 130, respectively. It is contemplated that the upper window 120 and the lower window 130 may be constructed from a material, such as quartz, that is substantially optically transparent. It is further contemplated that the material of the upper window 120 and the lower window 130 may be substantially transparent to infrared radiation, such that at least 95% of incident infrared radiation may be transmitted therethrough.

Figure 2A:
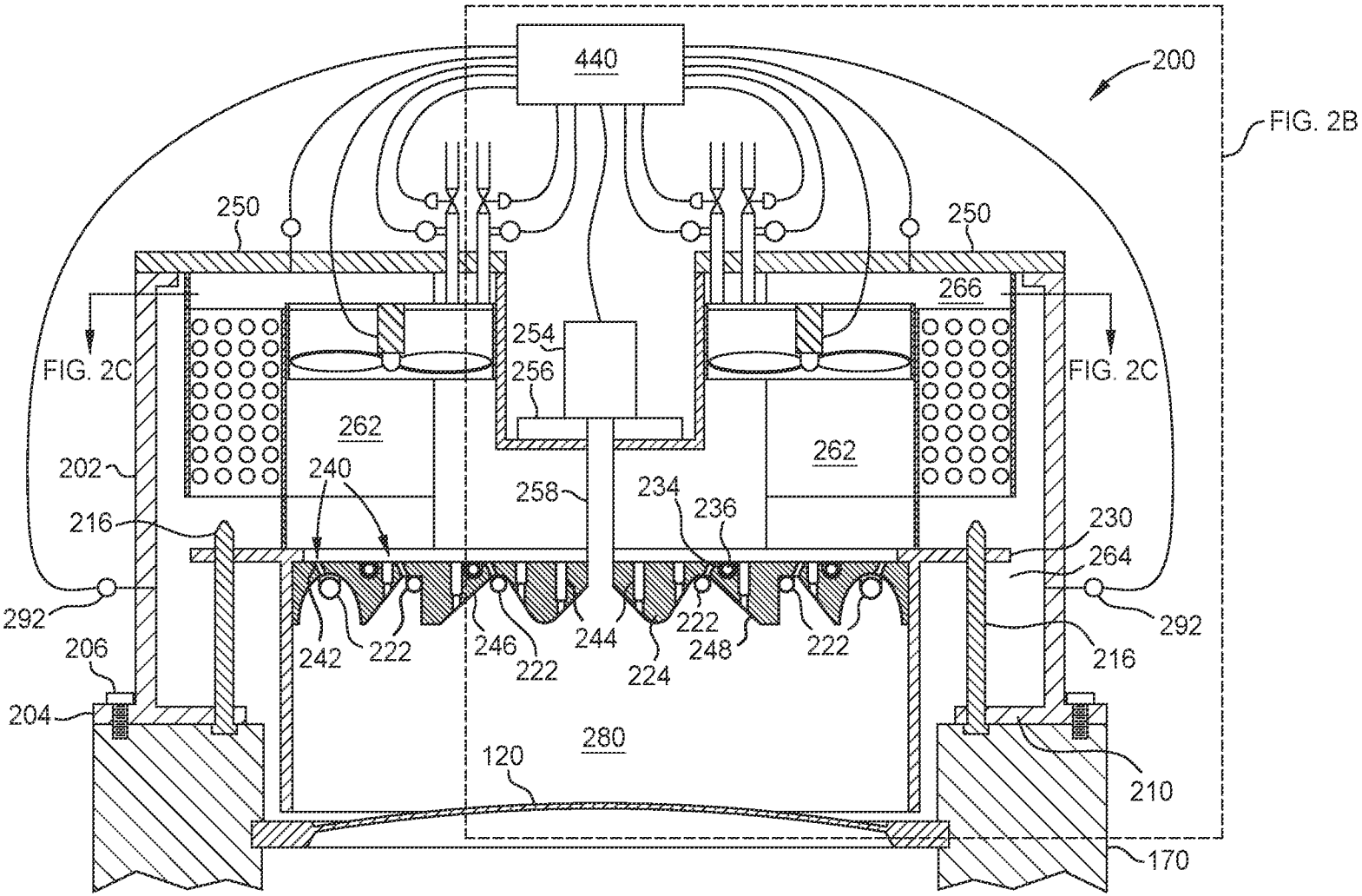
FIG. 2A is a schematic partial cross-sectional side view of an upper heating module of the processing chamber of FIG. 1.
Figure 2B:
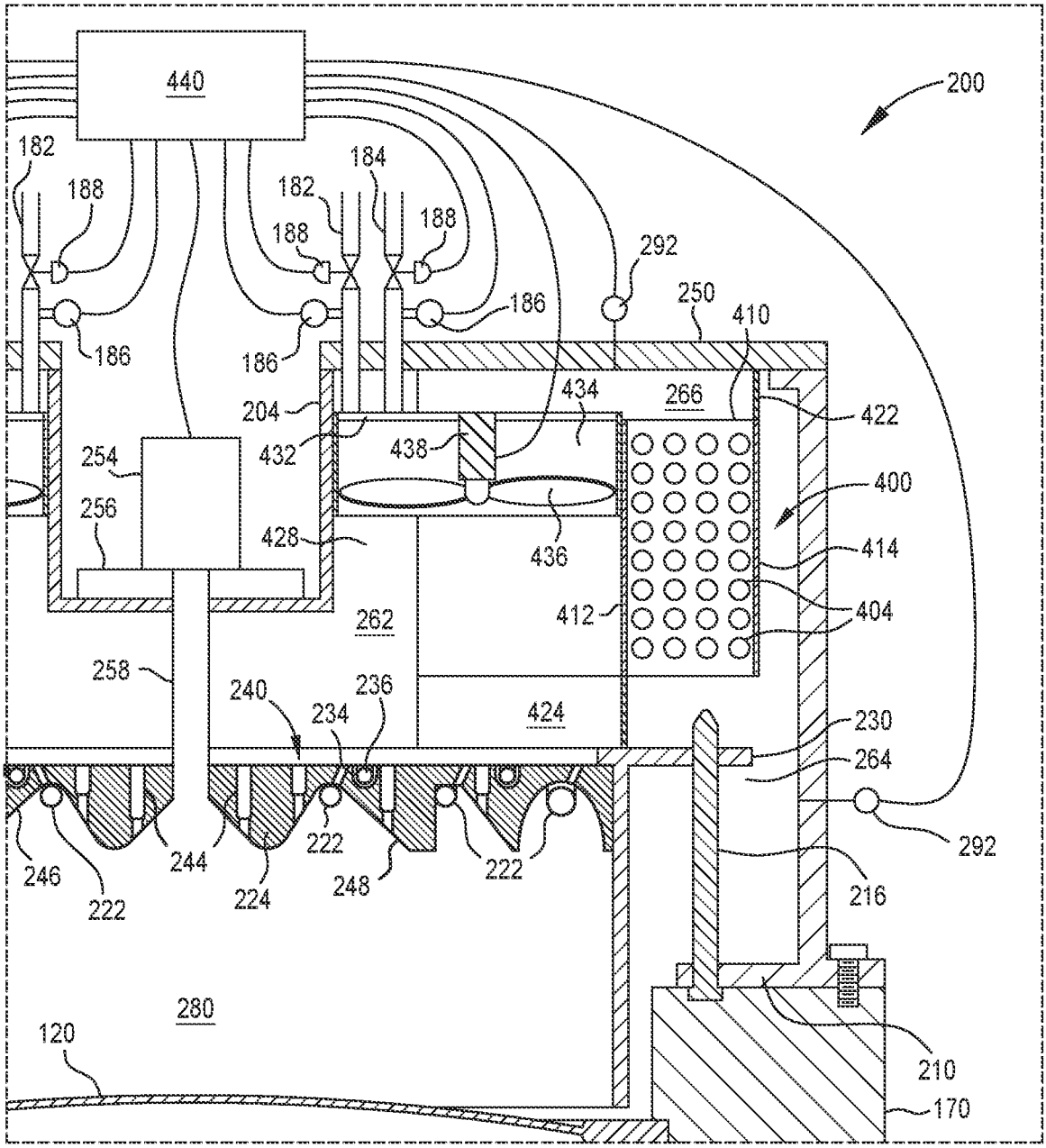
FIG. 2B is a detailed view of a portion of FIG. 2A.
Figure 2C:
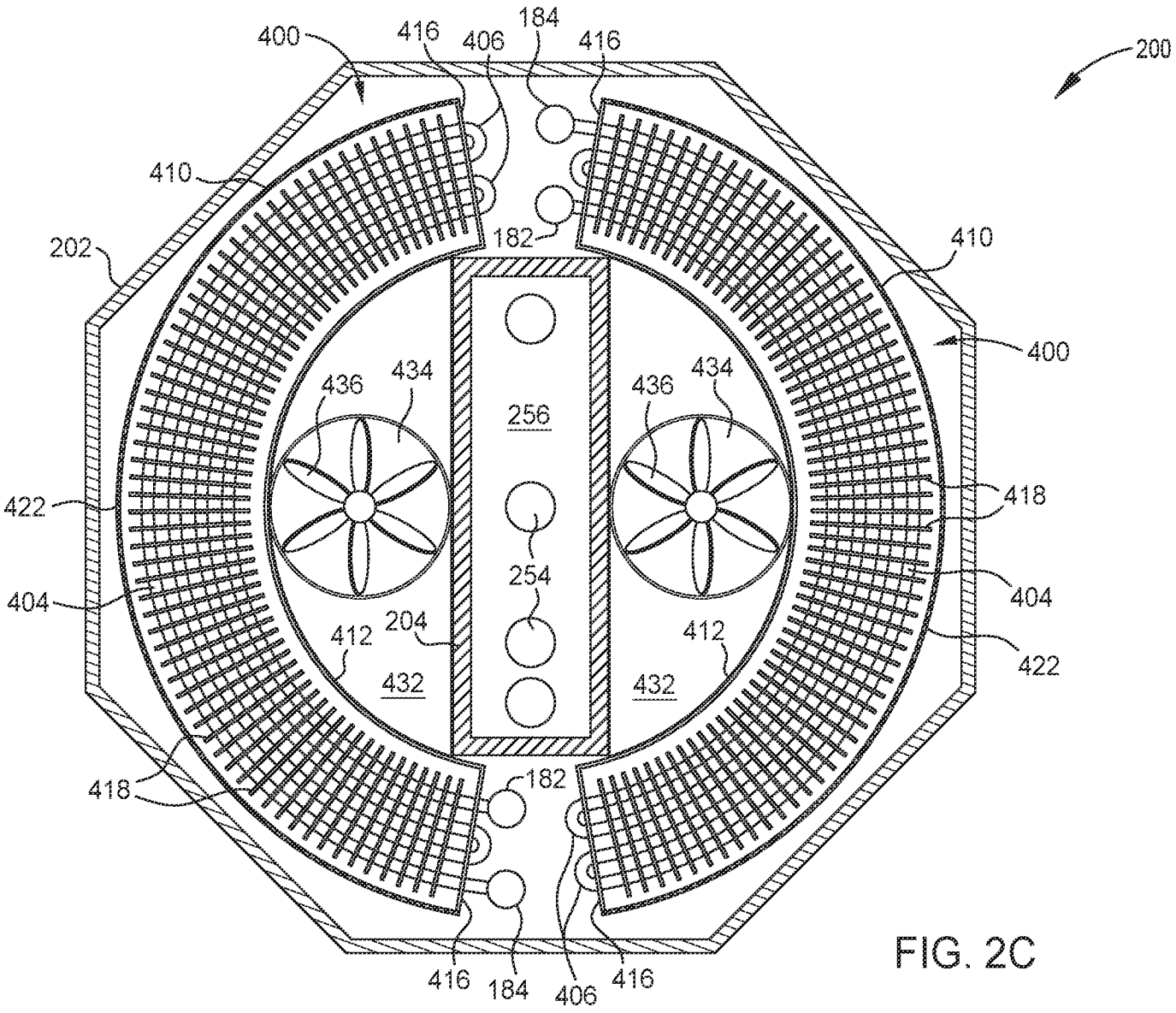
FIG. 2C is a schematic partial cross-sectional top view of the upper heating module of FIG. 2A.

FIGS. 2A-2C depict schematic views of the upper heating module 200. FIG. 2A is a schematic partial cross-sectional side view, FIG. 2B is a detailed view of a portion of FIG. 2A, and FIG. 2C is a schematic partial cross-sectional top view of the upper heating module 200. The upper heating module 200 includes an outer housing 202. The outer housing 202 generally is an annular body having a lower flange 204 through which one or more fasteners 206 extend for connection to the chamber body 300.

The outer housing 202 is coupled to a lamp mounting ring 210 disposed therein. The lamp mounting ring 210 is coupled to a reflector mounting ring 230 of a heating lamp assembly 220 by a plurality of fasteners 216, such as screws, bolts, rods, or the like.

The heating lamp assembly 220 includes a plurality of linear heating lamps 222 that extend across a central opening of the lamp mounting ring 210. An annular heat shield 280 is coupled to, and extends below, the reflector mounting ring 230. The annular heat shield 280 reflects heat from the linear heating lamps 222 towards the upper window 120. In some embodiments, it is contemplated that the annular heat shield 280 may be made from and/or coated with a reflective material. For example, the annular heat shield 280 may be gold plated.

The central opening of the lamp mounting ring 210 is substantially circular, and the annular heat shield 280 is substantially cylindrical. When the upper heating module 200 is assembled into the processing chamber 100, each linear heating lamp 222 extends substantially horizontally above the upper window 120. The linear heating lamps 222 are oriented substantially parallel to each other, such as within five degrees.

The reflector mounting ring 230 is disposed about and coupled to an upper surface 226 of an upper reflector plate 224. When the processing chamber 100 is assembled, the upper reflector plate 224 is disposed above the upper window 120. The upper reflector plate 224 is associated with the linear heating lamps 222. A lower surface 248 of the upper reflector plate 224 includes a plurality of linear channels 246 extending substantially parallel to each other across the lower surface 248. In some embodiments, it is contemplated that the lower surface 248 of the upper reflector plate 224 includes two or more linear channels 246. For example, the lower surface 248 of the upper reflector plate 224 may include three, four, five, six, seven, eight, nine, ten, or more linear channels 246. The plurality of linear heating lamps 222 extend within the plurality of linear channels 246, and heat from the linear heating lamps 222 is reflected off of sidewalls of the linear channels 246 towards the upper window 120 in addition to being radiated towards the upper window 120 directly. As shown in FIGS. 2A and 2B, each linear heating lamp 222 is located in a corresponding one of the plurality of linear channels 246. In some embodiments, it is contemplated that more than one linear heating lamp 222 may be located in a corresponding one of the plurality of linear channels 246.

Each linear channel 246 has a cross-sectional profile configured to reflect heat in a pre-determined distribution pattern. For example, the pre-determined distribution pattern may produce a substantially even distribution of heat. Alternatively, the pre-determined distribution pattern may focus peak irradiation at one or more specific regions on the substrate 110 undergoing processing to enable control of temperature at those regions. It is contemplated that each linear channel 246 has at least one of a U-shaped cross section; a geometric straight-sided cross section, such as a V-shaped cross section, a rectangular cross section, a pentagonal cross section, a hexagonal cross section, or greater than six-sided cross section; a curved cross section, such as a portion of a circle, a portion of an ellipse, or a portion of a parabola; or a combination thereof.

As an example, an elliptical cross-sectional shape may facilitate the focusing of infrared radiation from a linear heating lamp 222. As another example, a parabolic cross-sectional shape may facilitate the collimating of infrared radiation from a linear heating lamp 222. As a further example, an angular cross-sectional shape may facilitate the diffusion of infrared radiation from a linear heating lamp 222. In some embodiments, it is contemplated that one or more linear channel 246 may have a cross section that is the same as another one or more linear channel 246. In some embodiments, it is contemplated that one or more linear channel 246 may have a cross section that is different from another one or more linear channel 246. In some embodiments, it is contemplated that one or more linear channel 246 may have a cross section that varies from a first shape to a second shape along a length of the linear channel 246.

The lower surface 248 of the upper reflector plate 224 can be designed to deliver irradiance peaks at many locations across the substrate 110 undergoing processing to contribute to the facilitation of a desired thermal profile. In some embodiments, the upper reflector plate 224 is configured to generate up to as many irradiance peaks as the number of lamps in the plurality of linear heating lamps 222. In some embodiments, the upper reflector plate 224 is configured to generate a greater number of irradiance peaks than the number of lamps in the plurality of linear heating lamps 222. In some embodiments, it is contemplated that the upper reflector plate 224 may be made from and/or coated with a reflective material. For example, the upper reflector plate 224 may be gold plated. In some embodiments, the upper reflector plate 224 includes a plurality of portions that are coupled together to form a disk-shaped plate.

As shown in FIGS. 2A and 2B, the upper surface 226 of the upper reflector plate 224 includes a plurality of coolant channels 234. In some embodiments, the plurality of coolant channels 234 extend parallel to the plurality of linear heating lamps 222. A cooling tube 236 is disposed in each coolant channel 234 to convey a coolant, such as water or a refrigerant, such as R-22, R-32, or R-410A. In some embodiments, a single cooling tube 236 may be routed in one coolant channel 234, then out of the coolant channel 234 and across into another coolant channel 234. In some embodiments, the number of coolant channels 234 corresponds with the number of the plurality of linear channels 246. In some embodiments, it is contemplated that the coolant channels 234 and cooling tubes 236 may be omitted.

The upper reflector plate 224 includes apertures, such as cooling slots 240, extending from the upper surface 226 to the lower surface 248. The cooling slots 240 are configured to route a cooling gas, such as air, through the upper reflector plate 224. In some embodiments, it is contemplated that the cooling slots 240 may include a plurality of first slots 242 configured to cool the plurality of linear heating lamps 222 to maintain a target lamp temperature. An exemplary target lamp temperature is less than 800 degrees Celsius. As shown in FIG. 2A, the first slots 242 are configured to direct cooling gas generally towards each linear heating lamp 222. In some embodiments, it is contemplated that the cooling slots 240 may include a plurality of second slots 244 to direct the cooling gas towards the upper window 120. An exemplary target temperature of the upper window 120 is about 200 to about 600 degrees Celsius.

It is contemplated that the numbers, sizes, and/or flow areas of first slots 242 relative to second slots 244 may be configured according to a desired proportion of cooling gas to be flowed through each of the first slots 242 and the second slots 244. For example, it is contemplated that the desired total flow rate of cooling gas through the first slots 242 may be greater than, equal to, or less than the desired total flow rate of cooling gas through the second slots 244. Similarly, it is contemplated that the actual total flow rate of cooling gas through the first slots 242 may be greater than, equal to, or less than the actual total flow rate of cooling gas through the second slots 244. Thus, it is contemplated that the number of first slots 242 may be greater than, equal to, or less than the number of second slots 244. Additionally, it is contemplated that the size of first slots 242 may be greater than, equal to, or less than the size of second slots 244. Furthermore, it is contemplated that the flow area of first slots 242 may be greater than, equal to, or less than the flow area of second slots 244.

In some embodiments, it is contemplated that the cooling slots 240 are configured to give adequate backpressure to provide a desired flow pattern through the cooling slots 240. For example, the numbers, sizes, and/or flow areas of the cooling slots 240 may be configured such that the flow rate of cooling gas through one first slot 242 may be greater than, equal to, or less than the flow rate of cooling gas through another first slot 242. Similarly, the numbers, sizes, and/or flow areas of the cooling slots 240 may be configured such that the flow rate of cooling gas through one second slot 244 may be greater than, equal to, or less than the flow rate of cooling gas through another second slot 244.

A top plate 250 is coupled to the outer housing 202, and serves as a lid of the upper heating module 200. One or more temperature sensors, such as one or more pyrometers 254, are mounted to a base 256 on the top plate 250. In some embodiments, it is contemplated that the base 256 may include a heat exchanger to provide cooling by a suitable fluid, such as water, supplied via a connecting hose (not shown). Each pyrometer 254 may be mounted so as to measure the surface temperature of a discrete portion of the substrate 110 undergoing processing. In some embodiments, each pyrometer 254 may measure the surface temperature of a discrete portion of the upper window 120. Such measurements are facilitated via a corresponding pyrometer tube 258.

Figure 2D:
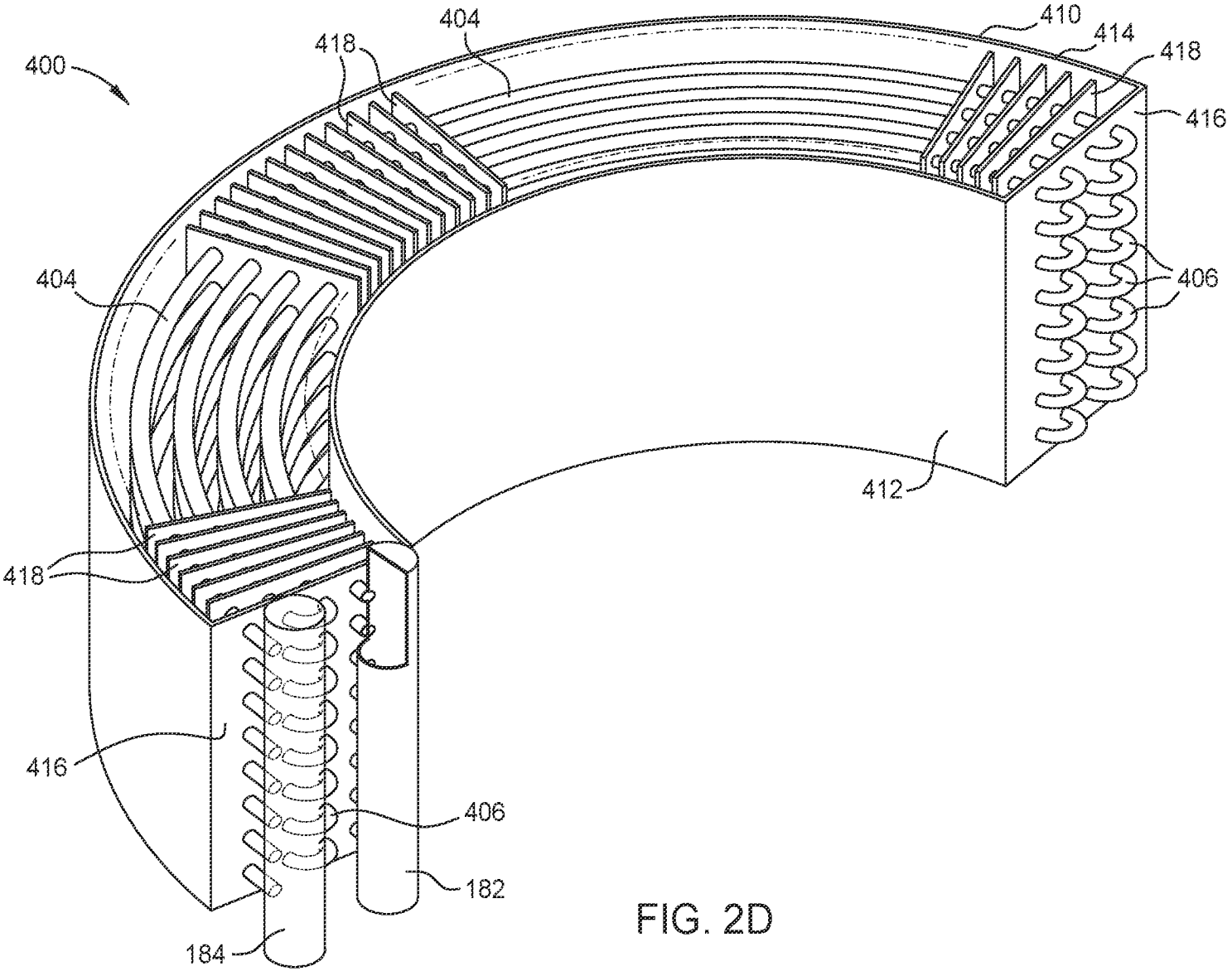
FIG. 2D is a schematic isometric view of a heat exchange module.

The upper heating module 200 includes one or more heat exchange modules 400 mounted above the heating lamp assembly 220. FIG. 2D is a schematic isometric view of a heat exchange module 400. The upper heating module 200 is illustrated as including two heat exchange modules 400, however, in some embodiments, the upper heating module 200 may include fewer or more heat exchange modules 400, such as one, three, four, five, or more.

With reference to FIGS. 2A-2D, each heat exchange module 400 includes one or more heat exchange tubes 404 mounted in an enclosure 410. The enclosure 410 includes an inner shroud 412 and an outer shroud 414, each extending between opposite end plates 416. As shown in the figures, the inner shroud 412, outer shroud 414 and heat exchange tubes 404 are curved in a horizontal plane. However, in some embodiments, the inner shroud 412, outer shroud 414 and heat exchange tubes 404 are not curved in a horizontal plane. In an example, each of the inner shroud 412, outer shroud 414 and heat exchange tubes 404 may be arranged in a straight line in a horizontal plane. In a further example, each of the inner shroud 412, outer shroud 414 and heat exchange tubes 404 may be arranged in a line in a horizontal plane that includes one or more obtuse angles. In such an example, each of the inner shroud 412, outer shroud 414, and heat exchange tubes 404 may be arranged in a line similar to two or more sides of a polygon.

As shown in FIGS. 2B and 2C, each heat exchange tube 404 is connected to the coolant inlet 182 and the coolant outlet 184. Each heat exchange tube 404 is configured to convey coolant from the coolant inlet 182 to the coolant outlet 184. As illustrated, each heat exchange tube 404 is connected to the coolant inlet 182 and the coolant outlet 184 in parallel. Each heat exchange tube 404 is arranged in multiple passes along the enclosure 410 between the end plates 416. The multiple passes are facilitated by one or more U-bends 406 in each heat exchange tube 404. As illustrated, each heat exchange tube 404 is arranged in four passes. However, in some embodiments, each heat exchange tube 404 may be arranged in any suitable number of passes, such as one, two, three, four, five, six, or more passes. Each end plate 416 of the enclosure 410 provides support to each heat exchange tube 404. As illustrated, in some embodiments, each heat exchange tube 404 penetrates each end plate 416, and at least a portion of each U-bend 406 is outside the enclosure 410.

The heat exchange module 400 includes one or more inner plates 418 within the enclosure 410. The inner plates 418 are coupled to each heat exchange tube 404. In some embodiments, the inner plates 418 are coupled to at least one of the inner shroud 412 or the outer shroud 414. In some embodiments, the inner plates 418 provide support for each heat exchange tube 404. The inner plates 418 provide a thermal connection with each heat exchange tube 404, and include surfaces that are contacted by the cooling gas within the upper heating module 200 that facilitate heat transfer between the cooling gas and the coolant within the heat exchange tubes 404.

In some embodiments, the heat exchange module 400 includes a baffle 422 extending upwards from the enclosure 410. As illustrated, the baffle 422 is an extension of the outer shroud 414, and is configured to contact the top plate 250 of the upper heating module 200. In some embodiments, the baffle 422 is configured to extend to a location that is close to the top plate 250 of the upper heating module 200. In embodiments in which the baffle 422 contacts or is close to the top plate 250, the proximity of the baffle 422 to the top plate 250 serves to inhibit the cooling gas from bypassing the enclosure 410, and direct the cooling gas into the enclosure 410. In some embodiments, the baffle 422 is not configured to contact or terminate close to the top plate 250. In some embodiments, the baffle 422 may be omitted.

In some embodiments, the heat exchange module 400 includes a skirt 424 extending downwards from the enclosure 410. As illustrated, the skirt 424 is an extension of the inner shroud 412, and is configured to contact the reflector mounting ring 230 of the upper heating module 200. In some embodiments, the skirt 424 is configured to extend to a location that is close to the reflector mounting ring 230 of the upper heating module 200. In embodiments in which the skirt 424 contacts or is close to the reflector mounting ring 230, the proximity of the skirt 424 to the reflector mounting ring 230 serves to inhibit the cooling gas from bypassing the enclosure 410, and direct the cooling gas into the enclosure 410. In some embodiments, the skirt 424 is not configured to contact or terminate close to the reflector mounting ring 230. In some embodiments, the skirt 424 may be omitted.

As shown in FIGS. 2B and 2C, a cover 432 extends from the inner shroud 412 of the enclosure 410 to an inner wall 204 of the upper heating module 200. One or more fans 436, each fan 436 including a motor 438, are coupled to the cover 432, and are configured to induce a flow of cooling gas through an aperture 434 in the cover 432. In some embodiments, one or more additional shrouds 428 are positioned within the upper heating module 200 in order to direct a flow of the cooling gas.

The enclosure 410, cover 432, fan 436, and annular heat shield 280 (and the baffle 422, skirt 424, and any additional shrouds 428 if present) divide the space within the upper heating module 200 into: a lower region 262 below the cover 432 and fan 436, and above the upper reflector plate 224; an annular region 264 between the outer housing 202 and the annular heat shield 280; and an upper region 266 between the top plate 250 and the cover 432, the fan 436, and the enclosure 410.

In some embodiments, valves 188 selectively prevent or permit coolant to flow from an external source to the coolant inlet 182 and return out of the coolant outlet 184. As shown, in some embodiments, the valves 188 may be operated by a controller 440 that is configured to control operation of the fan 436 and/or a flow of coolant. In some embodiments, the coolant is water. In some embodiments, the coolant is a refrigerant, such as R-22, R-32, or R-410A. In some embodiments, the coolant supplied to the heat exchange tubes 404 is the same coolant that is supplied to the cooling tube(s) 236. In some embodiments, the coolant supplied to the heat exchange tubes 404 is different from the coolant that is supplied to the cooling tube(s) 236.

As illustrated in FIG. 2B, in some embodiments, one or more first sensors 186 and/or one or more second sensors 292 may be positioned at one or more suitable locations in the upper heating module 200. The one or more first sensors 186 may measure one or more parameters associated with the coolant, such as pressure, temperature, or flow rate. The one or more second sensors 292 may measure one or more parameters associated with the cooling gas, such as pressure, temperature, or flow rate. It is contemplated that the one or more first sensors 186 and/or the one or more second sensors 292 and/or each fan motor 438, and/or each pyrometer 254 may be connected to the controller 440.

In some embodiments, when the upper heating module 200 is connected to the chamber body 170, the upper heating module 200 functions as a sealed container within which the cooling gas can circulate. In some embodiments, the upper heating module 200 includes a vent through which at least a portion of the cooling gas can move between an interior and an exterior of the upper heating module 200.

Figure 2E:
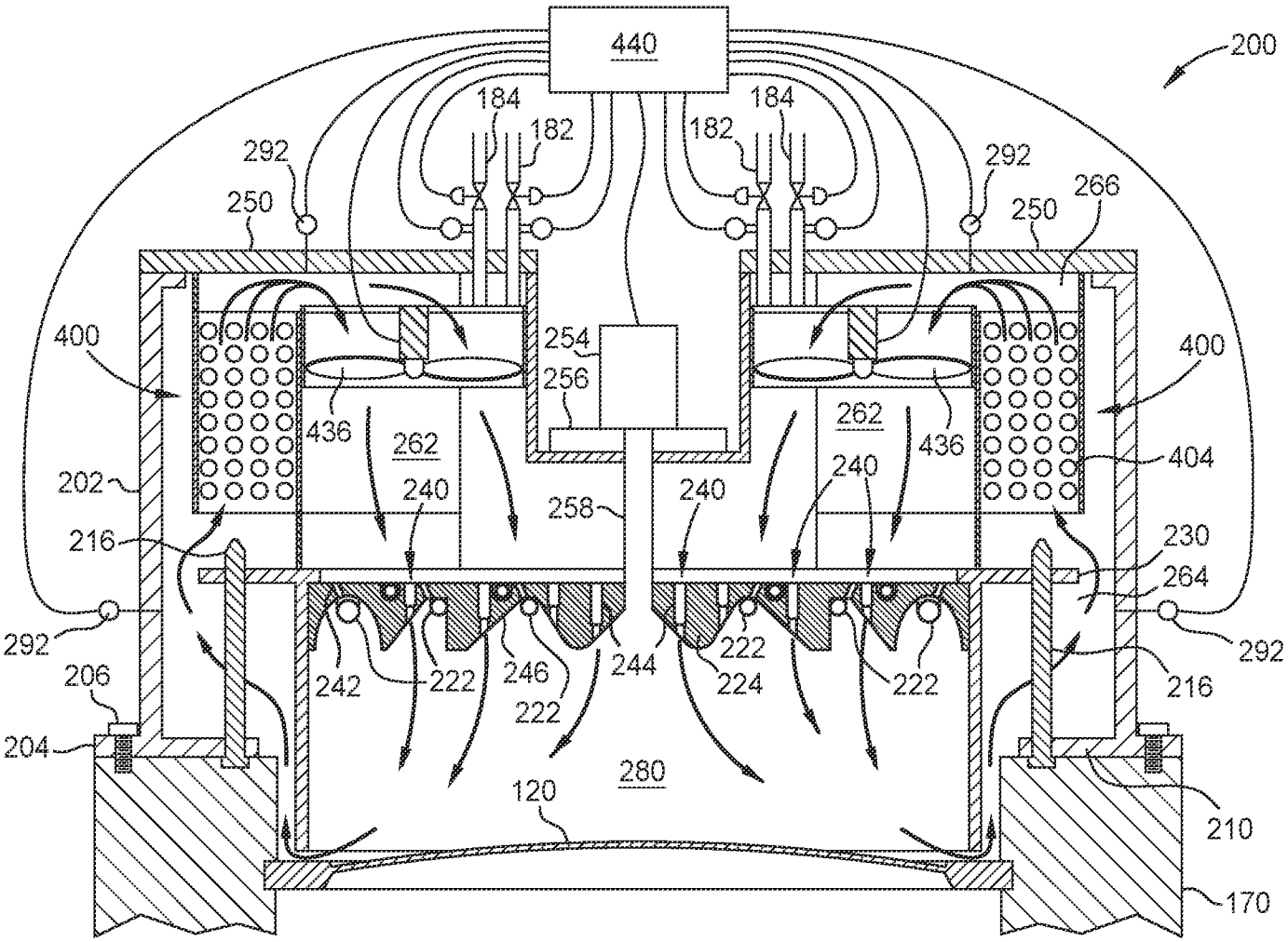
FIG. 2E is a schematic illustration of the flow of cooling gas within the upper heating module of FIG. 2A.

FIG. 2E is a schematic illustration of the flow of cooling gas within the upper heating module 200. The flow is indicated by arrows. During operation of the upper heating module 200, the controller 440 opens the valves 188 to permit the coolant to flow from the coolant inlet 182, through the heat exchange tubes 404, and out of the coolant outlet 184. The controller 440 operates the fan 436 via the motor 438. The fan 436 moves the cooling gas within lower region 262 through the cooling slots 240 in the upper reflector plate 224. The cooling gas cools the upper reflector plate 224, the heating lamps 222, and associated components attached to the upper reflector plate 224 or the heating lamps 222.

The cooling gas flows through the interior of the annular heat shield 280, and impinges on the upper window 120. The cooling gas cools the upper window 120, moves around the bottom of the annular heat shield 280, and flows upwards outside the annular heat shield 280. A temperature of the cooling gas increases due to heat transfer to the cooling gas from the upper reflector plate 224, the heating lamps 222, the associated components, the annular heat shield 280, and the upper window 120.

The cooling gas flows into the annular region 264 and then through the enclosure 410 of the heat exchange module 400. The cooling gas contacts the inner plates 418 and the heat exchange tubes 404, and heat from the cooling gas is transferred to the coolant in the heat exchange tubes 404. The temperature of the cooling gas is reduced by the heat transfer from the cooling gas to the coolant. The cooling gas flows out of the enclosure 410 of the heat exchange module 400, and into the upper region 266, where operation of the fan 436 draws the cooling gas back into the lower region 262.

During operation, the controller 440 monitors operational parameters, and regulates the flow of cooling gas and/or coolant in order to influence the temperature of the heating lamps 222, the components on the upper reflector plate 224 that are associated with the heating lamps 222, and/or the upper window 120. The controller monitors temperatures and/or pressures of the cooling gas at various locations in the upper heating module 200 via the sensors 292. In some embodiments, the controller may monitor a flow rate of the cooling gas via the current draw of the motor 438 of the fan 436. The controller monitors temperatures and/or pressures and/or flow rates of the coolant via the sensors 186. By monitoring pressures and/or flow rates of the coolant, the controller can determine whether any leakage of coolant is occurring within each heat exchange module 400.

Figure 3A:
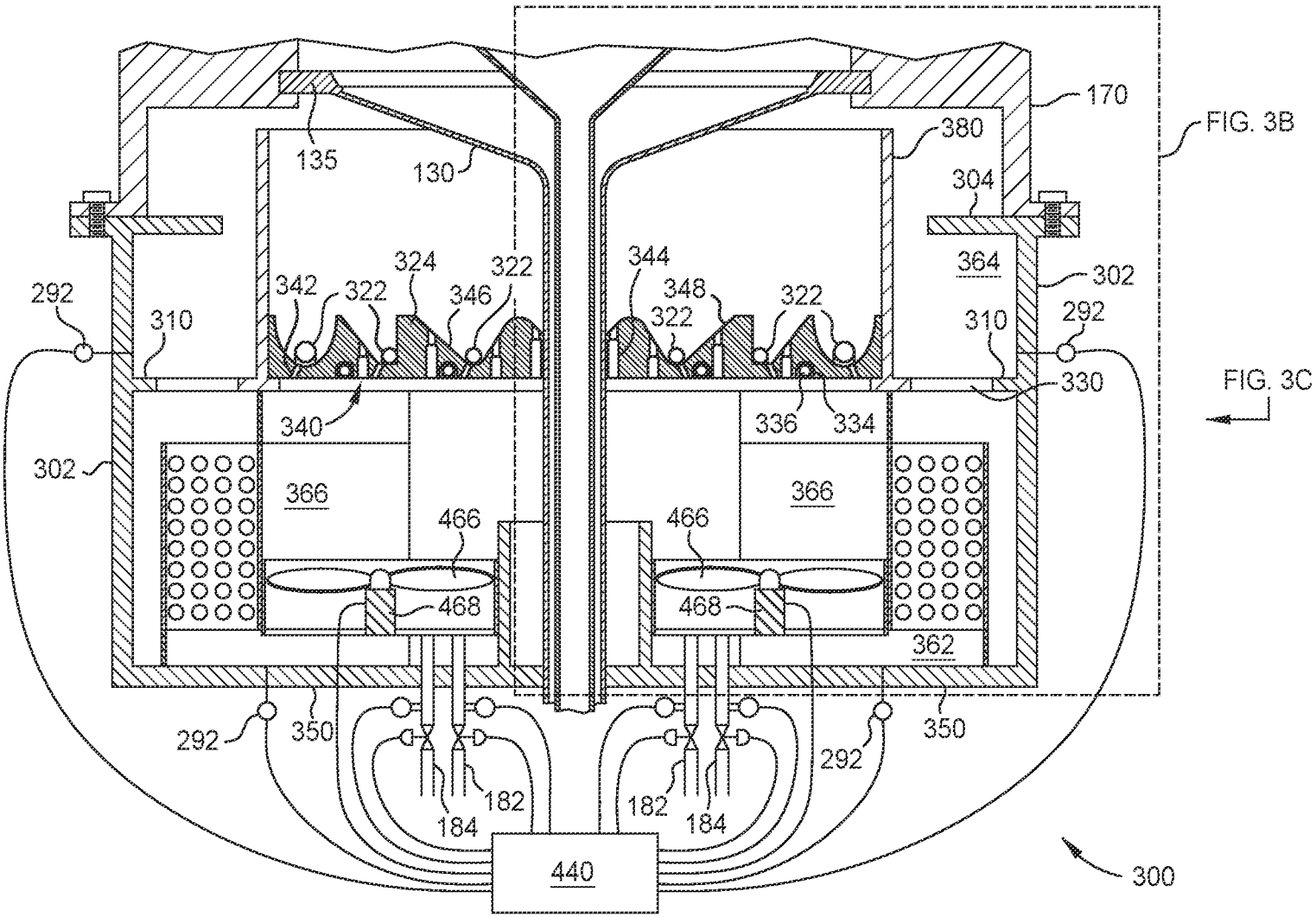
FIG. 3A is a schematic partial cross-sectional side view of a lower heating module of the processing chamber of FIG. 1.
Figure 3B:
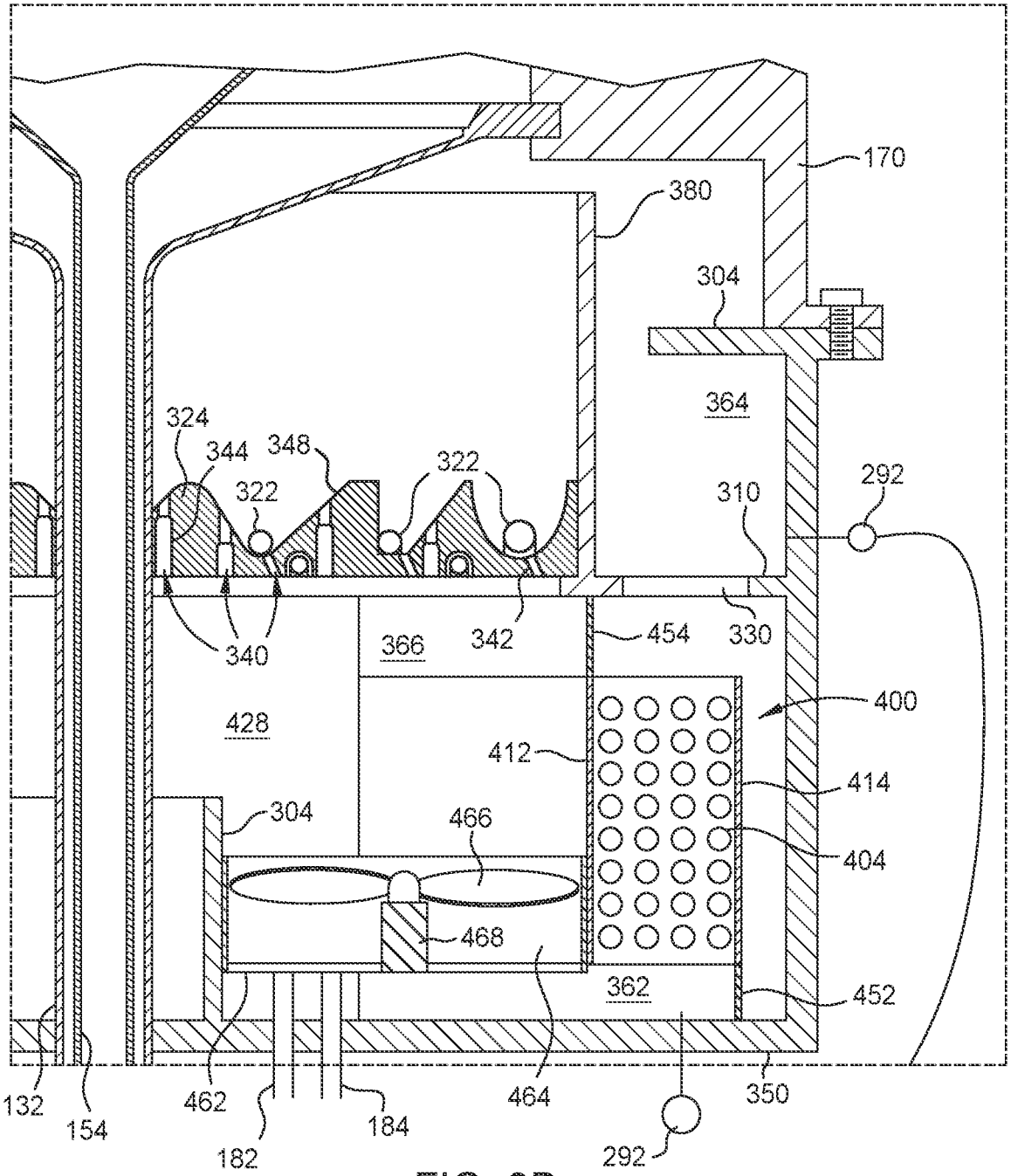
FIG. 3B is a detailed view of a portion of FIG. 3A.
Figure 3C:
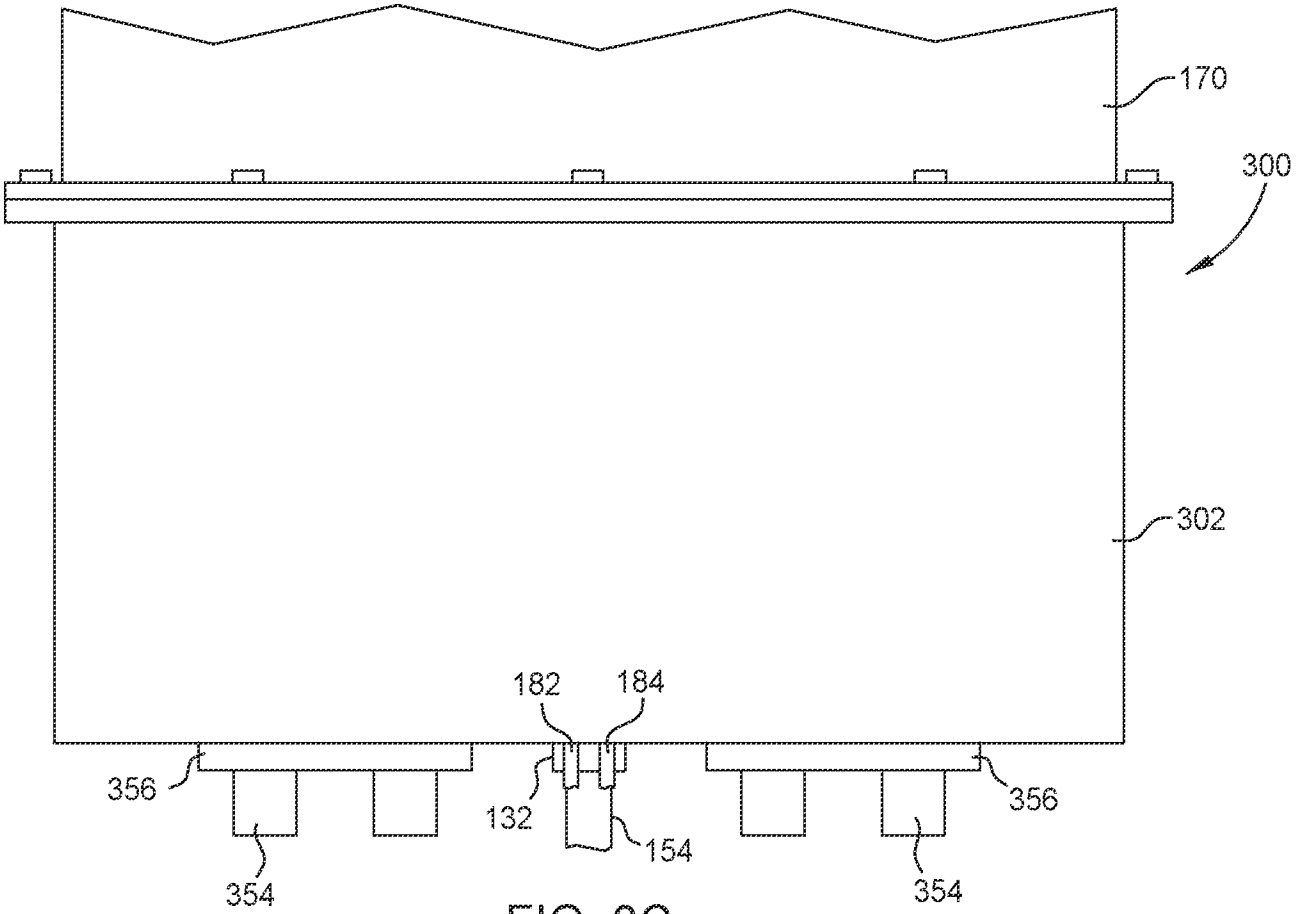
FIG. 3C is a side view of the lower heating module of FIG. 3A.

FIG. 3A is a schematic partial cross-sectional side view of the lower heating module 300, FIG. 3B is a detailed view of a portion of FIG. 3A, and FIG. 3C is a side view of the lower heating module 300 taken in a direction perpendicular to the view of FIG. 3A. The lower heating module 300 includes an outer housing 302. The outer housing 302 generally is an annular body coupled to, or integral with, an adapter plate 306. Fasteners 308 connect the adapter plate 306 to the chamber body 170 when the processing chamber 100 is assembled.

The outer housing 302 is coupled to a separation plate 310 disposed therein. The separation plate 310 is coupled to a heating lamp assembly 320. The heating lamp assembly 320 includes a plurality of linear heating lamps 322 that extend across a central opening of the separation plate 310. An annular heat shield 380 is coupled to the separation plate 310. The annular heat shield 380 reflects heat from the linear heating lamps 322 towards the lower window 130. In some embodiments, it is contemplated that the annular heat shield 380 may be made from and/or coated with a reflective material. For example, the annular heat shield 380 may be gold plated.

The central opening of the separation plate 310 is substantially circular, and the annular heat shield 380 is substantially cylindrical. When the lower heating module 300 is assembled into the process chamber 100, each linear heating lamp 322 extends substantially horizontally below the lower window 130. The linear heating lamps 322 are oriented substantially parallel to each other, such as within five degrees.

A lower reflector plate 324 is coupled to, and disposed within, the annular heat shield 380. When the process chamber 100 is assembled, the lower reflector plate 324 is disposed below the lower window 130. The lower reflector plate 324 is associated with the linear heating lamps 322. An upper surface 348 of the lower reflector plate 324 includes a plurality of linear channels 346 extending substantially parallel to each other across the upper surface 348. In some embodiments, it is contemplated that the upper surface 348 of the lower reflector plate 324 includes two or more linear channels 346. For example, the upper surface 348 of the lower reflector plate 324 may include three, four, five, six, seven, eight, nine, ten, or more linear channels 346. The plurality of linear heating lamps 322 extend within the plurality of linear channels 346, and thus heat from the linear heating lamps 322 is reflected off of sidewalls of the linear channels 346 towards the lower window 130 in addition to being radiated towards the lower window 130 directly. As shown in FIGS. 3A and 3B, each linear heating lamp 322 is located in a corresponding one of the plurality of linear channels 346. In some embodiments, it is contemplated that more than one linear heating lamp 322 may be located in a corresponding one of the plurality of linear channels 346.

Each linear channel 346 has a cross-sectional profile configured to reflect heat in a pre-determined distribution pattern. For example, the pre-determined distribution pattern may produce a substantially even distribution of heat. Alternatively, the pre-determined distribution pattern may focus peak irradiation at one or more specific regions on an underside of the susceptor 150 to enable control of temperature at those regions. It is contemplated that each linear channel 346 has at least one of a U-shaped cross section; a geometric straight-sided cross section, such as a V-shaped cross section, a rectangular cross section, a pentagonal cross section, a hexagonal cross section, or greater than six-sided cross section; a curved cross section, such as a portion of a circle, a portion of an ellipse, or a portion of a parabola; or a combination thereof.

As an example, an elliptical cross-sectional shape may facilitate the focusing of infrared radiation from a linear heating lamp 322. As another example, a parabolic cross-sectional shape may facilitate the collimating of infrared radiation from a linear heating lamp 322. As a further example, an angular cross-sectional shape may facilitate the diffusion of infrared radiation from a linear heating lamp 322. In some embodiments, it is contemplated that one or more linear channel 346 may have a cross section that is the same as another one or more linear channel 346. In some embodiments, it is contemplated that one or more linear channel 346 may have a cross section that is different from another one or more linear channel 346. In some embodiments, it is contemplated that one or more linear channel 346 may have a cross section that varies from a first shape to a second shape along a length of the linear channel 346.

The upper surface 348 of the lower reflector plate 324 can be designed to deliver irradiance peaks at many locations across the underside of the susceptor 150 to contribute to the facilitation of a desired thermal profile. In some embodiments, the lower reflector plate 324 is configured to generate up to as many irradiance peaks as the number of lamps in the plurality of linear heating lamps 322. In some embodiments, the lower reflector plate 324 is configured to generate a greater number of irradiance peaks than the number of lamps in the plurality of linear heating lamps 322. In some embodiments, it is contemplated that the lower reflector plate 324 may be made from and/or coated with a reflective material. For example, the lower reflector plate 324 may be gold plated.

A neck shield 382 extends through the lower reflector plate 324. The neck shield 382 is configured to be disposed about the neck 132 of the lower window 130. The neck shield 382 reflects heat away from the neck 132 of the lower window 130. In some embodiments, it is contemplated that the neck shield 382 may be made from and/or coated with a reflective material. For example, the neck shield 382 may be gold plated.

As illustrated, a lower surface 326 of the lower reflector plate 324 includes a plurality of coolant channels 334. In some embodiments, the plurality of coolant channels 334 extend parallel to the plurality of linear heating lamps 322. A cooling tube 336 is disposed in each coolant channel 334 to convey a coolant, such as water or a refrigerant, such as R-22, R-32, or R-410A. In some embodiments, a single cooling tube 336 may be routed in one coolant channel 334, then out of the coolant channel 334 and across into another coolant channel 334. In some embodiments, the number of coolant channels 334 corresponds with the number of the plurality of linear channels 346. In some embodiments, it is contemplated that the coolant channels 334 and cooling tubes 336 may be omitted.

The lower reflector plate 324 includes apertures, such as cooling slots 340, extending from the lower surface 326 to the upper surface 348. The cooling slots 340 are configured to route a cooling fluid, such as a gas, such as air, through the lower reflector plate 324. In some embodiments, it is contemplated that the cooling slots 340 may include a plurality of first slots 342 configured to cool the plurality of linear heating lamps 322 to maintain a target lamp temperature. An exemplary target lamp temperature is less than 800 degrees Celsius. As shown in FIG. 2, the first slots 342 are configured to direct cooling fluid generally towards each linear heating lamp 322. In some embodiments, it is contemplated that the cooling slots 340 may include a plurality of second slots 344 to direct the cooling fluid towards the lower window 130. An exemplary target temperature of the lower window 130 is about 400 to about 600 degrees Celsius.

It is contemplated that the numbers, sizes, and/or flow areas of first slots 342 relative to second slots 344 may be configured according to a desired proportion of cooling fluid to be flowed through each of the first slots 342 and the second slots 344. For example, it is contemplated that the desired total flow rate of cooling fluid through the first slots 342 may be greater than, equal to, or less than the desired total flow rate of cooling fluid through the second slots 344. Similarly, it is contemplated that the actual total flow rate of cooling fluid through the first slots 342 may be greater than, equal to, or less than the actual total flow rate of cooling fluid through the second slots 344. Thus, it is contemplated that the number of first slots 342 may be greater than, equal to, or less than the number of second slots 344. Additionally, it is contemplated that the size of first slots 342 may be greater than, equal to, or less than the size of second slots 344. Furthermore, it is contemplated that the flow area of first slots 342 may be greater than, equal to, or less than the flow area of second slots 344.

In some embodiments, it is contemplated that the cooling slots 340 are configured to give adequate backpressure to provide a desired flow pattern through the cooling slots 340. For example, the numbers, sizes, and/or flow areas of the cooling slots 340 may be configured such that the flow rate of cooling fluid through one first slot 342 may be greater than, equal to, or less than the flow rate of cooling fluid through another first slot 342. Similarly, the numbers, sizes, and/or flow areas of the cooling slots 340 may be configured such that the flow rate of cooling fluid through one second slot 344 may be greater than, equal to, or less than the flow rate of cooling fluid through another second slot 344.

A bottom cover 350 is coupled to the outer housing 302, and serves as a lid of the lower heating module 300. As shown in FIG. 3C, one or more temperature sensors, such as one or more pyrometers 354, are mounted to a base 356 on the bottom cover 350. In some embodiments, it is contemplated that the base 356 may include a heat exchanger to provide cooling by a suitable fluid, such as water, supplied via a connecting hose (not shown). It is contemplated that each pyrometer 354 may be mounted so as to measure the surface temperature of a discrete portion of the underside of the susceptor 150. In some embodiments, each pyrometer 354 may measure the surface temperature of a discrete portion of the lower window 130. It is further contemplated that such measurements may be facilitated via a corresponding pyrometer tube (not shown) projecting through a hole in the lower reflector plate 324, however in some embodiments, the corresponding pyrometer tube may be omitted.

Returning to FIGS. 3A and 3B, the lower heating module 300 includes one or more heat exchange modules 400 mounted below the heating lamp assembly 320. The lower heating module 300 is illustrated as including two heat exchange modules 400, however, in some embodiments, the lower heating module 300 may include fewer or more heat exchange modules 400, such as one, three, four, five, or more. Each heat exchange module 400 is configured as described above.

As illustrated, in some embodiments, the heat exchange module 400 includes an outer baffle 452 extending downwards from the enclosure 410. As illustrated, the outer baffle 452 is an extension of the outer shroud 414, and is configured to contact the bottom cover 350 of the lower heating module 300. In some embodiments, the outer baffle 452 is configured to extend to a location that is close to the bottom cover 350 of the lower heating module 300. In embodiments in which the outer baffle 452 contacts or is close to the bottom cover 350, the proximity of the outer baffle 452 to the bottom cover 350 serves to inhibit the cooling gas from bypassing the enclosure 410, and direct the cooling gas into the enclosure 410. In some embodiments, the outer baffle 452 is not configured to contact or terminate close to the bottom cover 350. In some embodiments, the outer baffle 452 may be omitted.

In some embodiments, the heat exchange module 400 includes an inner baffle 454 extending downwards from the enclosure 410. As illustrated, the inner baffle 454 is an extension of the inner shroud 412, and is configured to contact the separation plate 310 of the lower heating module 300. In some embodiments, the inner baffle 454 is configured to extend to a location that is close to the separation plate 310 of the lower heating module 200. In embodiments in which the inner baffle 454 contacts or is close to the separation plate 310, the proximity of the inner baffle 454 to the separation plate 310 serves to inhibit the cooling gas from bypassing the circulation route described below. In some embodiments, the inner baffle 454 is not configured to contact or terminate close to the separation plate 310. In some embodiments, the inner baffle 454 may be omitted.

As illustrated, one or more apertures 330 in the separation plate 310 provide a flow path for cooling gas towards the enclosure 410 of the heat exchange module 400.

A cover 462 extends from the inner shroud 412 of the enclosure 410 to an inner wall 304 of the lower heating module 300. One or more fans 466, each fan 466 including a motor 468, are coupled to the cover 462, and are configured to induce a flow of cooling gas through an aperture 464 in the cover 462. In some embodiments, one or more additional shrouds 458 are positioned within the lower heating module 300 in order to direct a flow of the cooling gas.

The enclosure 410, cover 462, and fan 466 (and the outer baffle 452, inner baffle 454, and any additional shrouds 458 if present) divide the space within the lower heating module 300 into: a lower region 362 between the bottom cover 350 and the cover 462, the fan 466, and the enclosure 410; and an upper region 366 above the cover 462 and fan 466, and below the lower reflector plate 324. An annular region 364 exists between the outer housing 302 and the annular heat shield 380.

Referring to FIG. 3A, in some embodiments, valves 188 selectively prevent or permit coolant to flow from an external source to the coolant inlet 182 and return out of the coolant outlet 184. As shown, in some embodiments, the valves 188 may be operated by the controller 440. In some embodiments, the coolant is water. In some embodiments, the coolant is a refrigerant, such as R-22, R-32, or R-410A. In some embodiments, the coolant supplied to the heat exchange tubes 404 is the same coolant that is supplied to the cooling tube(s) 336. In some embodiments, the coolant supplied to the heat exchange tubes 404 is different from the coolant that is supplied to the cooling tube(s) 336.

In some embodiments, one or more first sensors 186 and/or one or more second sensors 292 may be positioned at one or more suitable locations in the lower heating module 300. The one or more first sensors 186 may measure one or more parameters associated with the coolant, such as pressure, temperature, or flow rate. The one or more second sensors 292 may measure one or more parameters associated with the cooling gas, such as pressure, temperature, or flow rate. It is contemplated that the one or more first sensors 186 and/or the one or more second sensors 292 and/or each fan motor 468, and/or each pyrometer 354 may be connected to the controller 440.

In some embodiments, when the lower heating module 300 is connected to the chamber body 170, the lower heating module 300 functions as a sealed container within which the cooling gas can circulate. In some embodiments, the lower heating module 300 includes a vent through which at least a portion of the cooling gas can move between an interior and an exterior of the lower heating module 300.

Figure 3D:
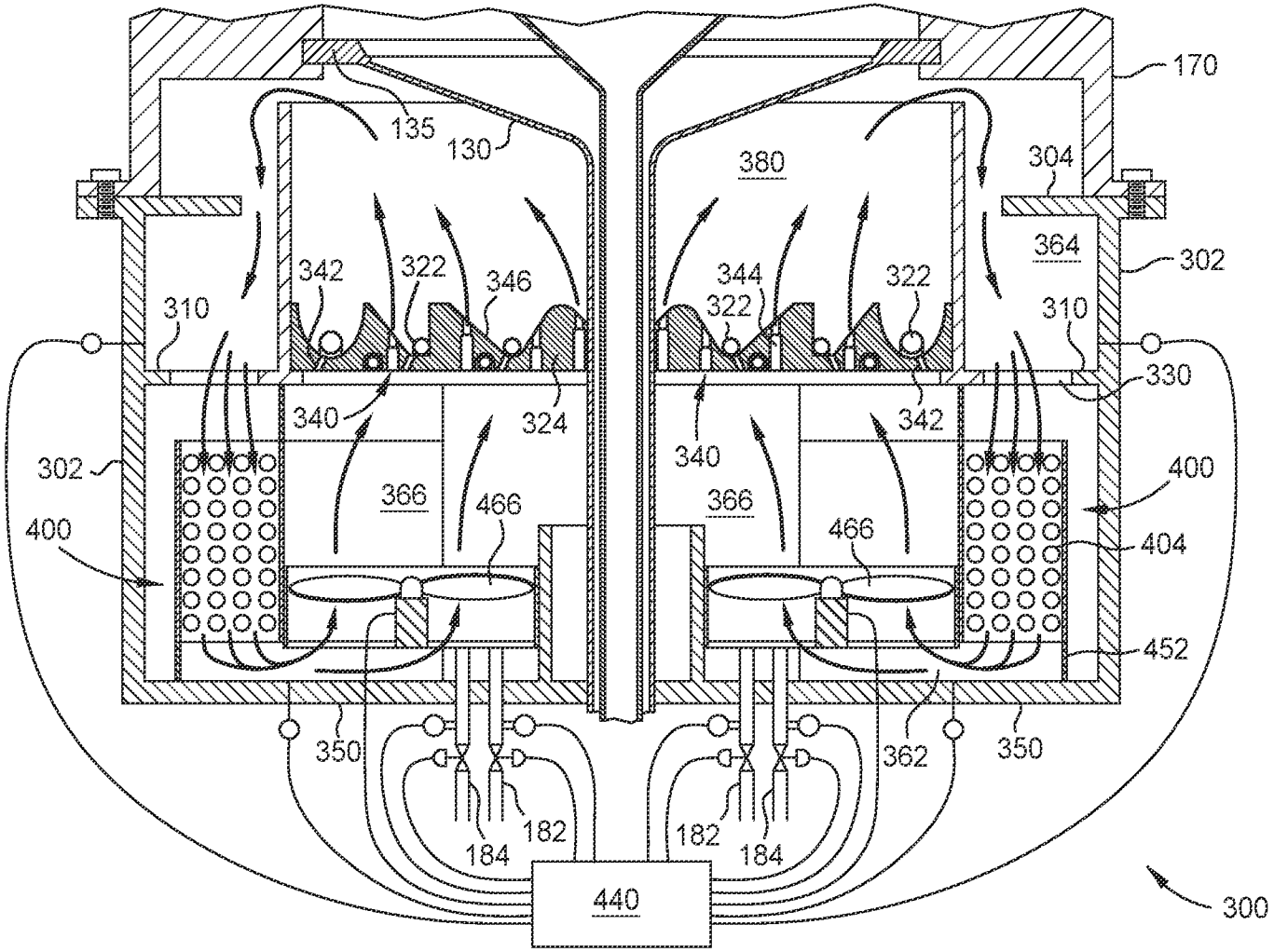
FIG. 3D is a schematic illustration of the flow of cooling gas within the lower heating module of FIG. 3A.

FIG. 3D is a schematic illustration of the flow of cooling gas within the lower heating module 300. The flow is indicated by arrows. During operation of the lower heating module 300, the controller 440 opens the valves 188 to permit the coolant to flow from the coolant inlet 182, through the heat exchange tubes 404, and out of the coolant outlet 184. The controller 440 operates the fan 466 via the motor 468. The fan 466 moves the cooling gas within upper region 366 through the cooling slots 340 in the lower reflector plate 324. The cooling gas cools the lower reflector plate 324, the heating lamps 322, and associated components attached to the lower reflector plate 324 or the heating lamps 322.

The cooling gas flows through the interior of the annular heat shield 380, and impinges on the lower window 130. The cooling gas cools the lower window 130, moves around the top of the annular heat shield 380, and flows downwards within the annular region 364. A temperature of the cooling gas increases due to heat transfer to the cooling gas from the lower reflector plate 324, the heating lamps 322, the associated components, the annular heat shield 380, and the lower window 130.

The cooling gas flows through the one or more apertures 330 in the separation plate 310 and into the enclosure 410 of the heat exchange module 400. The cooling gas contacts the inner plates 418 and the heat exchange tubes 404, and heat from the cooling gas is transferred to the coolant in the heat exchange tubes 404. The temperature of the cooling gas is reduced by the heat transfer from the cooling gas to the coolant. The cooling gas flows out of the enclosure 410 of the heat exchange module 400, and into the lower region 362, where operation of the fan 466 draws the cooling gas back into the upper region 366.

During operation, the controller 440 monitors operational parameters, and regulates the flow of cooling gas and/or coolant in order to influence the temperature of the heating lamps 322, the components on the lower reflector plate 324 that are associated with the heating lamps 322, and/or the lower window 130. The controller 440 monitors temperatures and/or pressures of the cooling gas at various locations in the lower heating module 300 via the sensors 292. In some embodiments, the controller 440 may monitor a flow rate of the cooling gas via the current draw of the motor 468 of the fan 466. The controller 440 monitors temperatures and/or pressures and/or flow rates of the coolant via the sensors 186. By monitoring pressures and/or flow rates of the coolant, the controller 440 can determine whether any leakage of coolant is occurring within each heat exchange module 400.

It is contemplated that the controller 440 includes a central processing unit (CPU), a memory containing instructions, and support circuits for the CPU. The controller 440 is of any form of a general-purpose computer processor that is used in an industrial setting for controlling various chambers and equipment and/or sub-processors thereon or therein. In some aspects, one or more controllers 440 are used to controller aspects of the chamber 100.

The memory, or non-transitory computer readable medium, is one or more of a readily available memory such as random access memory (RAM), read only memory (ROM), floppy disk, hard disk, flash drive, or any other form of digital storage, local or remote. The support circuits are coupled to the CPU for supporting the CPU (a processor). The support circuits include cache, power supplies, clock circuits, input/output circuitry and subsystems, and the like. Operations and operating parameters are stored in the memory as a software routine that is executed or invoked to turn the controller 440 into a specific purpose controller to control the operations of any of individual heat exchange modules 400 within the upper heating module 200, individual heat exchange modules 400 within the lower heating module 300, individual valves 188 of the upper heating module 200, individual valves 188 of the lower heating module 300, individual fans 436 within the upper heating module 200, and/or individual fans 466 within the lower heating module 300. The controller 440 is configured to conduct any of the operations described herein. The instructions stored on the memory, when executed, cause one or more of the operations described herein to be conducted.

In some embodiments, data from any of sensors 186, 292, and/or any other sensor associated with the processing chamber 100 may be used to provide feedback to the controller 440. In some embodiments, data of electrical current through any of fans 436, 466, heating lamps 222, 322, and/or any other electrically-driven component associated with the processing chamber 100 may be used to provide feedback to the controller 440. The controller 440 uses the data so provided as an input to process commands addressed to any of fan 436, fan 466, and/or any valve 188.

The instructions in the memory of the controller 440 can include one or more machine learning/artificial intelligence algorithms that can be executed in addition to the operations described herein. As an example, a machine learning/artificial intelligence algorithm executed by the controller 440 can tune and alter operational parameters based on the data received. The operational parameters can include, for example, pressures, temperatures, and flow rates of the coolant and/or the cooling gas. The operational parameters can include, for example, a status of each valve 188 with respect to fully open and/or fully closed. The operational parameters can include, for example, a speed of each fan 436, 466. In some embodiments, the one or more machine learning/artificial intelligence algorithms can prompt the controller 440 to initiate corrective action in order to adjust any operational parameter.

Embodiments of the present disclosure provide compact cooling systems that are contained within a heating module. The cooling systems do not rely on a cooling gas to be supplied through dedicated ducting, which allows for the elimination of components (such as ducting) ancillary to a processing chamber, and so saves on space and enhances access around the processing chamber.

It is contemplated that elements and features of any one disclosed embodiment may be beneficially incorporated in one or more other embodiments. While the foregoing is directed to embodiments of the present disclosure, other and further embodiments of the disclosure may be devised without departing from the basic scope thereof, and the scope thereof is determined by the claims that follow.

What is claimed is:

1. A heating module for a process chamber suitable for use in semiconductor manufacturing, the heating module comprising:

an outer housing including a sidewall extending to a lid;

a reflector plate disposed in the outer housing;

a plurality of heating lamps associated with the reflector plate; and a first heat exchange module disposed in the outer housing between the reflector plate and the lid, the first heat exchange module including:

a plurality of first heat exchange tubes disposed between a first inner shroud and a first outer shroud; and a baffle extending from the first outer shroud to the lid.

2. The heating module of claim 1, wherein the first heat exchange module further comprises a plurality of plates coupled to each first heat exchange tube.

3. The heating module of claim 1, wherein each first heat exchange tube is coupled to a coolant inlet and a coolant outlet.

4. The heating module of claim 3, wherein each first heat exchange tube is arranged in multiple passes between the first inner shroud and the first outer shroud, and includes one or more U-bends.

5. The heating module of claim 1, wherein the first heat exchange module further comprises a first fan disposed between the reflector plate and the lid.

6. The heating module of claim 5, wherein:

an annular heat shield extends from the reflector plate;

a space within the heating module is divided into:

a first region between the first fan and the lid;

a second region between the first fan and the reflector plate; and a third region between the annular heat shield and the outer housing; and the first fan is configured to blow a cooling gas within the heating module in a circuit comprising:

drawing the cooling gas from the first region into the second region;

blowing the cooling gas from the second region through a plurality of apertures in the reflector plate and through the annular heat shield;

conveying the cooling gas from the annular heat shield into the third region; and conveying the cooling gas from the third region between the first inner shroud and the first outer shroud around the first heat exchange tubes, and into the first region.

7. The heating module of claim 1, wherein the first heat exchange module further comprises a skirt extending from the first inner shroud to a reflector mounting ring coupled to the reflector plate.

8. The heating module of claim 1, further comprising a second heat exchange module disposed between the reflector plate and the lid, the second heat exchange module including a plurality of second heat exchange tubes disposed between a second inner shroud and a second outer shroud.

9. The heating module of claim 8, further comprising a second fan disposed between the reflector plate and the lid.

10. The heating module of claim 1, further comprising a cooling tube coupled to the reflector plate.

11. The heating module of claim 10, wherein the first heat exchange tubes are configured to convey a first coolant, and the cooling tube is configured to convey a second coolant different from the first coolant.

12. A processing chamber suitable for use in semiconductor manufacturing, comprising:

a chamber body including a upper window disposed above a lower window, the upper window and the lower window forming boundaries of a processing volume; and an upper heating module coupled to the chamber body above the upper window, the upper heating module including:

a first outer housing including a sidewall extending to a first lid;

a first reflector plate disposed in the first outer housing;

a plurality of first heating lamps associated with the first reflector plate; and a first heat exchange module disposed in the first outer housing between the first reflector plate and the first lid, the first heat exchange module including a plurality of first heat exchange tubes disposed between a first inner shroud and a first outer shroud; and a baffle extending from the first outer shroud to the first lid.

13. The processing chamber of claim 12, further comprising:

a lower heating module coupled to the chamber body below the lower window, the lower heating module including:

a second outer housing;

a second lid on the second outer housing;

a second reflector plate disposed in the second outer housing;

a plurality of second heating lamps associated with the second reflector plate; and a second heat exchange module disposed between the second reflector plate and the second lid, the second heat exchange module including a plurality of second heat exchange tubes disposed between a second inner shroud and a second outer shroud.

14. The processing chamber of claim 13, further comprising a controller configured to control operation of a first fan of the first heat exchange module and a second fan of the second heat exchange module.

* * * * *